US006619779B2

(12) United States Patent
Jeon et al.

(10) Patent No.: US 6,619,779 B2
(45) Date of Patent: Sep. 16, 2003

(54) INK-JET PRINTER HEAD

(75) Inventors: Chan-bong Jeon, Seoul (KR); Chang-Youl Moon, Suwon (KR); Min-soo Kim, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/964,512

(22) Filed: Sep. 28, 2001

(65) Prior Publication Data

US 2002/0041301 A1 Apr. 11, 2002

(30) Foreign Application Priority Data

Sep. 29, 2000 (KR) ..... 2000-57512

(51) Int. Cl.[7] ..... B41J 2/015

(52) U.S. Cl. ..... 347/20; 347/63; 347/64; 347/65

(58) Field of Search ..... 347/20, 23, 63, 347/64, 65, 66

(56) References Cited

U.S. PATENT DOCUMENTS 4,896,171 A * 1/1990 Ito ..... 347/63
4,922,265 A * 5/1990 Pan et al. ..... 347/47
6,340,223 B1 * 1/2002 Hirata ..... 347/56

* cited by examiner

*Primary Examiner*—Lamson Nguyen
*Assistant Examiner*—Ly T Tran
(74) *Attorney, Agent, or Firm*—Staas & Halsey LLP

(57) ABSTRACT

An ink-jet printer head includes a base plate having ink channels penetrating through the base plate, through which ink is supplied, a hollow heat driving section formed in the base plate and encircling an exit of the ink channels, an ink chamber barrier stacked on the base plate for serving as a side wall of an ink chamber where ink is reserved, and a nozzle plate stacked on the ink chamber barrier and having a nozzle which communicates with the ink channels and the ink chamber coaxially. Accordingly, an area occupied by the unit nozzle can be reduced, and ink flow in the ink chamber is easily controlled, thereby enhancing a printing speed and a print quality.

15 Claims, 6 Drawing Sheets

INK-JET PRINTER HEAD

CROSS-REFERENCE TO RELATED APPLICATION

This application claims the benefit of Korean Application No. 2000-57512, filed Sep. 29, 2000, in the Korean Industrial Property Office, the disclosure of which is incorporated herein by reference.

BACKGROUND OF THE INVENTION

1. Field of the Invention

The present invention relates to an ink-jet printer head, and more particularly, to a thermal ink-jet printer head of an upward ejecting type and which has improved on the construction of an ink channel so that the area occupied by a unit nozzle can be reduced and an ejected ink droplet can be stabilized.

2. Description of Related Art

An ink ejecting method applied to an ink-jet printer head is generally classified into a thermal driving method and a piezoelectric driving method. In the thermal driving method, ink is instantaneously heated by a resistance heating element, thereby generating and expanding a bubble, and is ejected through a nozzle by the pressure of the bubble. In the piezoelectric driving method, ink is ejected through the nozzle by the pressure generated by the displacement of a piezoelectric element.

Further, the ink-jet printer head of the thermal driving method is classified into a side ejecting type of FIG. 1 and an upward ejecting type of FIG. 2 according to an ink ejecting direction with respect to a base plate and a nozzle plate.

An ink-jet printer head 21 of the side ejecting type as shown in FIG. 1 comprises an ink channel 23, a nozzle 26 formed at one end of the ink channel 23, and a resistance heating element 2 for instantaneously heating the ink in the ink channel 23 to generate and expand a bubble 22, wherein an ink droplet 29 around the nozzle 26 is ejected by the pressure of the bubble 22.

The ink-jet printer head of the upward ejecting type as shown in FIG. 2, comprises a nozzle 36, an ink chamber 39, an ink channel 34 disposed at a side of the ink chamber 39 for supplying ink therethrough, and a resistance heating element 2 for heating the ink in the ink chamber 39 to generate and expand a bubble, wherein an ink droplet is ejected through the nozzle 36 by the expansion pressure of the bubble generated and expanded in the ink chamber 39.

The aforementioned conventional ink-jet printer head, however, has shortcomings of the so-called back-flow of ink, which means that ink flows back into the inner side of the ink channel 23 or 34 due to the expansion pressure of the bubble generated when ejecting ink. The back-flow causes a cross-talk during a printing process, and thus causes a deteriorated print quality.

To solve the problem as described above, the conventional side ejecting type has an elongated ink channel 23 and a protective barrier 24 made of a polymer or the like, which is disposed above a heat driving section including the resistance heating element 2, for preventing the back-flow of ink. However, in the construction as described above, since a unit nozzle occupies a broad area of the base plate, it is required for the ink-jet printer head to be lengthened accordingly, and thus the manufacturing process thereof is complicated.

The conventional upward ejecting type as shown in FIG. 2 has a protruding portion 37 with a neck formed on the ink channel 34 connected to the ink chamber 39, thereby preventing the back-flow of ink. However, due to a complicated manufacturing process and structure, the manufacturing becomes difficult.

Meanwhile, an ink manifold of the conventional ink-jet printer head is formed by wet etching, and the ink channel thereof is formed by laser ablation.

The problem is that the laser ablation deteriorates a quality of the treated surface. Also, the wet etching has problems such as a long treating time, use of chemicals that causes environmental problems, and imprecise treatment.

SUMMARY OF THE INVENTION

In order to improve the ink-jet printer head as described above, an object of the present invention is to provide an upward ejecting type of a thermal ink-jet printer head capable of reducing an area occupied by a unit nozzle, and thus enhancing a printing speed and a print resolution by improving a structure of an ink channel.

Another object of the present invention is to provide an upward ejecting type of a thermal ink-jet printer head capable of stabilizing an ejected ink droplet, and thus enhancing a printing efficiency by improving a structure of an ink channel.

Additional objects and advantages of the invention will be set forth in part in the description which follows and, in part, will be obvious from the description, or may be learned by practice of the invention.

To achieve the above and other objects, an ink-jet printer head in accordance with the present invention includes a base plate having ink channels penetrating therethrough, a donut shaped heat driving section formed in the base plate and encircling an exit of the ink channels, an ink chamber barrier stacked on the base plate for serving as a side wall of an ink chamber, and a nozzle plate stacked on the ink chamber barrier and having a nozzle for ejecting out the ink in the ink chamber.

Here, preferably, the base plate, the ink channels, the ink chamber, and the heat driving section are symmetrical with respect to a shared axis thereof.

The ink channels include an ink manifold formed by hollowing the lower portion of the base plate to have a predetermined area therein and an ink supplying path formed by being hollowed to have a narrower area therein than that of the ink manifold, which connects the ink manifold with the ink chamber.

BRIEF DESCRIPTION OF THE DRAWINGS

The objects and characteristics of the present invention will be more apparent by describing the preferred embodiment of the present invention with reference to the accompanied reference drawings, in which.

DETAILED DESCRIPTION OF THE PREFERRED EMBODIMENTS

Figure 1:
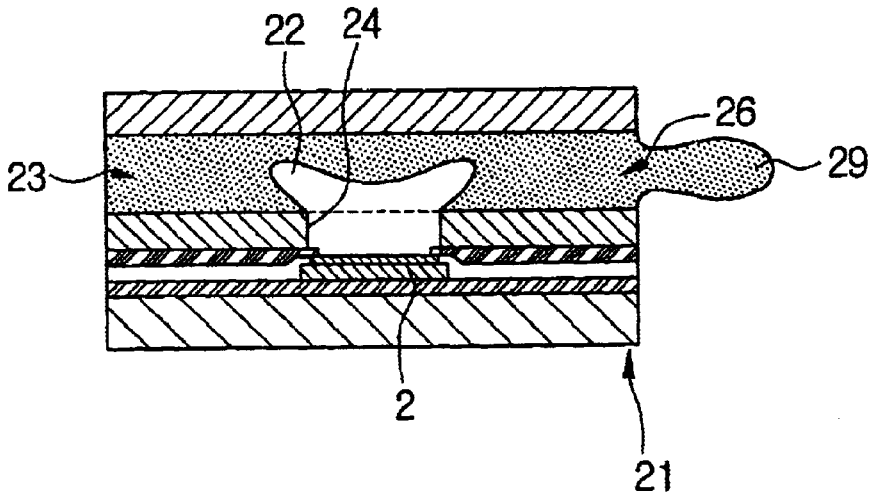
FIG. 1 (PRIOR ART)
FIG. 1 is a schematic section view showing a unit nozzle of an ink-jet printer head of a side ejecting type.
Figure 2:
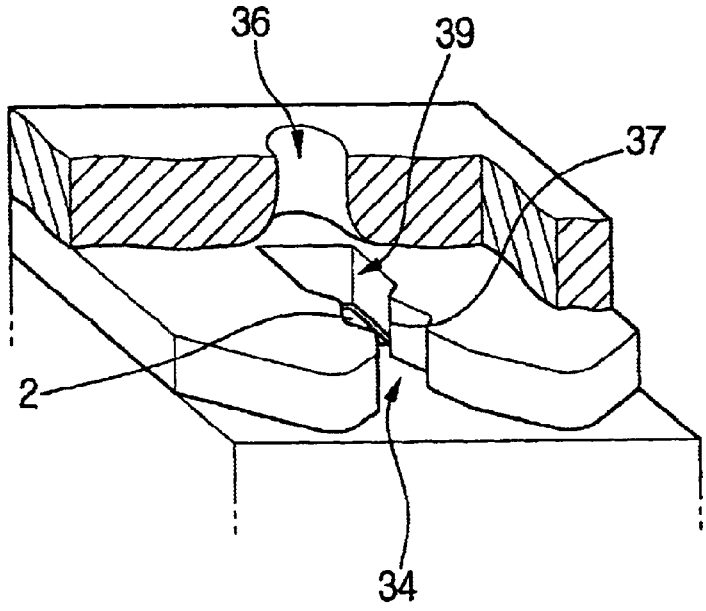
FIG. 2 (PRIOR ART)
FIG. 2 is a partially broken perspective view showing a unit nozzle of an ink jet printer head of an upward ejecting type.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
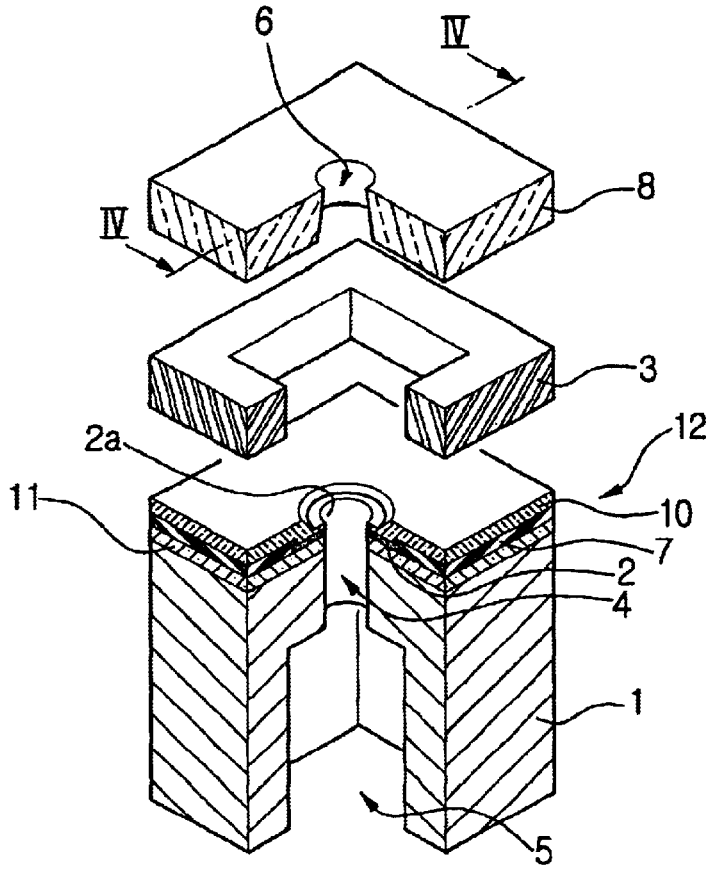
FIG. 3 is an exploded perspective view of a partially cut a unit nozzle of an ink-jet printer head according to an embodiment of the present invention.
Figure 4:
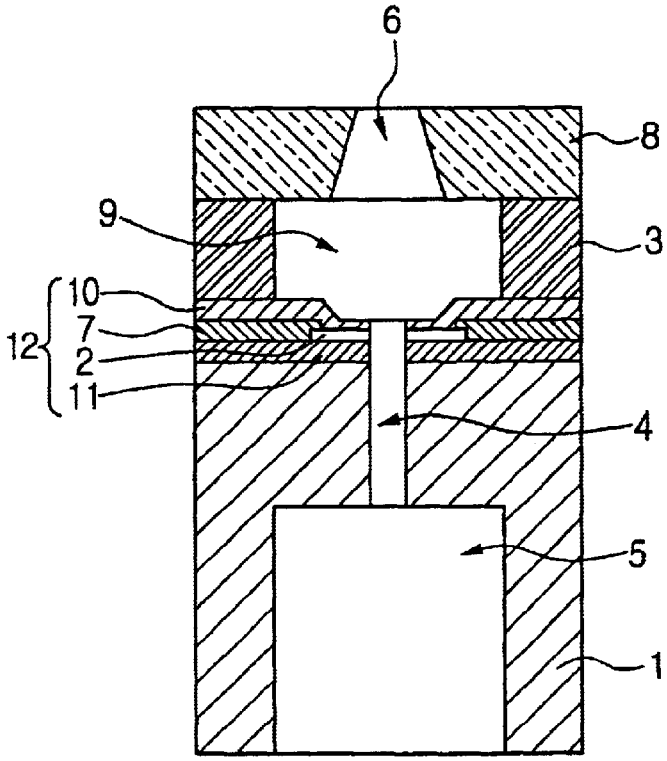
FIG. 4 is section view on line IV—IV of FIG. 3.

Referring to FIGS. 3 and 4, a unit nozzle of an ink-jet printer head comprises a base plate 1 formed by being hollowed to have ink channels therein, a hollow heat driving section 12 formed in the base plate 1 and encircling an exit of the ink channels, an ink chamber barrier 3 stacked on the base plate 1 for serving as a sidewall of an ink chamber 9 where ink is reserved, and a nozzle plate 8 stacked on the ink chamber barrier 3 and having a nozzle 6 which communicates with ink channels 4 and 5 (later referred to as an ink supplying path and an ink manifold respectively) and the ink chamber 9 coaxially.

The base plate 1, ink channels 4 and 5, ink chamber 9, and heat driving section 12 are symmetrical with respect to a shared axis, respectively.

The base plate 1 is made of a silicon wafer that is generally used for manufacturing semiconductors. As shown, the base plate 1 has an ink manifold 5 formed by hollowing the lower portion of the base plate 1 to be connected to an ink reservoir (not shown) and an ink supplying path 4 formed by being hollowed to have a narrower area than the ink manifold 5, which connects the ink manifold 5 with the ink chamber 9.

Accordingly, the ink in the ink reservoir flows into the ink chamber 9 through the ink channels including the ink manifold 5 and the ink supplying path 4.

The heat driving section 12 is stacked on the top surface of the base plate 1 for instantaneously heating the ink in the ink chamber 9. The heat driving section 12 includes an oxide film 11, a resistance heating element 2, an electrode layer 7 etched in a predetermined pattern in order for the top surface of the resistance heating element 2 to be exposed and stacked on the resistance heating element 2, and a protective layer 10 for covering the resistance heating element 2 and the electrode layer 7. The oxide film 11, resistance heating element 2, electrode layer 7, and protective layer 10 are sequentially stacked on the base plate 1.

The oxide film 11 is stacked on the base plate 1 for cutting heat and electric current transmitted to the base plate 1 from the heating resistance element 2. The protective layer 10 covers the resistance heating element 2 and the electrode layer 7 to protect from a shock generated when bubble shrinks. Here, preferably, the resistance heating element 2 is made of a resistance element such as a Ta—Al or a poly silicon.

The heat driving section 12 has a passage hole 2*a* formed in the center thereof. The passage hole 2*a* serves as an exit of the ink supplying path 4 so that ink flows into the ink chamber 9 through the ink manifold 5 and the ink supplying path 4.

The ink chamber barrier 3 is formed by, for example, stacking a photosensitive polymer on the base plate 1 and then treating the photosensitive polymer in a predetermined pattern by dry etching. Alternatively, the ink chamber barrier 3 is integrally formed with the nozzle plate 8 or is stacked on the nozzle plate 8. To put it another way, there are several methods of forming the ink chamber barrier 3, one of which is stacking the photosensitive polymer on the base plate 1 and then etching the photosensitive polymer in a predetermined pattern, another of which is stacking a adhesive layer on the nozzle plate 8 and then treating the adhesive layer by dry etching, and still another of which is forming integrally with the nozzle 6 by etching the nozzle plate 8. For example, in the case that the nozzle plate 8 is made of a polymer, the adhesive layer of 0.5~1.0 mil is coated on the polymer of 1 mil and then the ink chamber barrier 3 is formed by treating the adhesive layer by dry etching. Here, 1 mil corresponds to $1/1000$ inch, and dry etching is performed by ICP (Inductive coupled plasma) using a plasma.

The nozzle plate 8 is made of polymer made of a polyamide or Ni. A plurality of nozzles 6 is formed in the nozzle plate 8, and the nozzles 6 correspond to the unit ink chamber 9, respectively.

Meanwhile, the ink supplying path 4 and the ink manifold 5 are shaped into either a hollow cylinder or a hollow rectangle. Alternatively, the ink supplying path 4 and the ink manifold 5 may be a combination of a hollow cylinder and a hollow rectangle. The ink supply path 4 and the ink manifold 5 according to the embodiment of the present invention are shaped into a hollow cylinder and a hollow rectangle, respectively.

In the ink-jet printer head constructed as above according to the present invention, the ink manifold 5 is formed by hollowing the lower portion of the base plate 1 by a predetermined depth by sandblasting, which is different from the prior art. The ink supplying path 4 is formed by treating the upper portion of the base plate 1 above the ink manifold 5 by dry etching.

Since the ink supplying path 4 and the ink manifold 5 are formed by dry etching and sandblasting, respectively, precise treating is guaranteed, and thus the area of the unit nozzle can be reduced.

Referring to FIGS. 5A through 5F, an ink ejecting operation of the ink-jet printer head according to the present invention is described as follows.

Figure 5A:
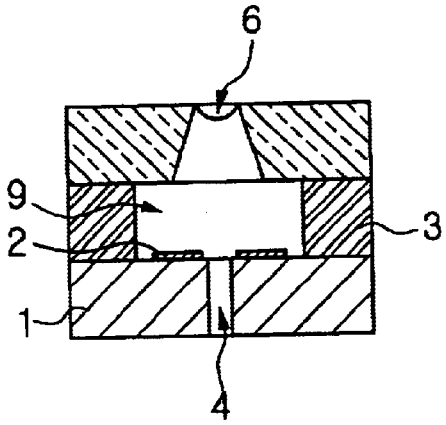
FIGS. 5A through 5F are schematic section views illustrating an ink ejecting operation of an ink-jet printer head according to the present invention.
Figure 5B:
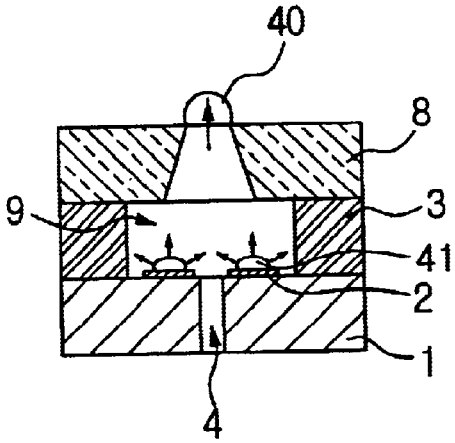

First, as shown in FIG. 5A, ink flows into the ink chamber 9 through the ink manifold 5 (shown in FIG. 4) and the ink supplying path 4 and is statically reserved in the ink chamber 9. As shown in FIG. 5B, such reserved ink is heated by the resistance heating element 2 to generate a bubble 41.

The bubble 41 expands along the profile of the resistance heating element 2, i.e., the bubble 41 expands in a donut shape. At this time, since the expansion pressure direction around the ink supplying path 4 is vertical with respect to the direction of ink flowing through the ink supplying path 4, the back flow of ink, which may occur during the bubble 41 generation, can be reduced considerably. Further, the ink in the upper portion of the ink chamber 9 is subjected to the expansion pressure of the bubble 41, thereby generating a droplet 40 at the nozzle 6.

Figure 5C:
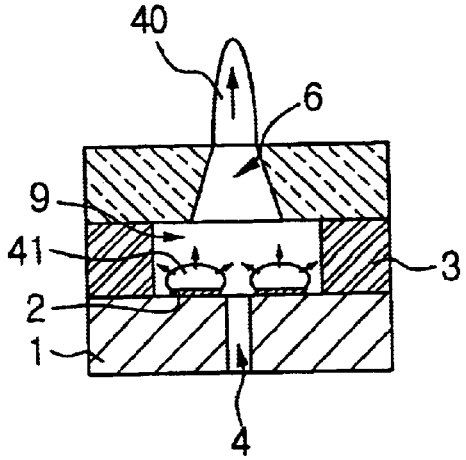

As shown in FIG. 5C, as the bubble 41 expands by being heated by the resistance heating element 2, the droplet 40 at an external side of the nozzle 6 is expanded rapidly by the expansion pressure of the bubble 41 accordingly.

Figure 5D:
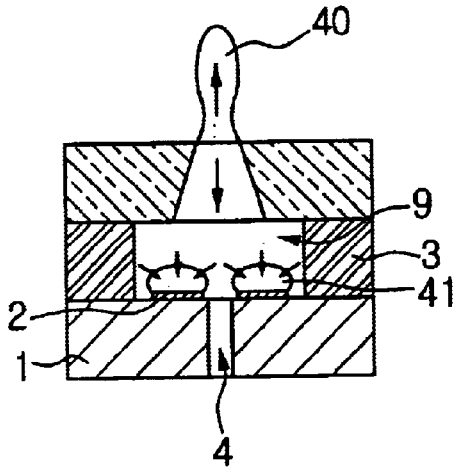

As shown in FIG. 5D, when the bubble 41 expands to a maximum size, the electric signal externally supplied to the resistance heating element 2 is cut. Accordingly, the resistance heating element 2 does not heat ink any more so that bubble 41 shrinks. At this time, the droplet 40 at the external side of the nozzle 6 is apt to be ejected out from the nozzle 6 due to the inertial force of the droplet 40, while the ink in the ink chamber 9 is subjected to the force toward the ink supplying path 4 due to the shrinkage of the bubble.

Figure 5E:
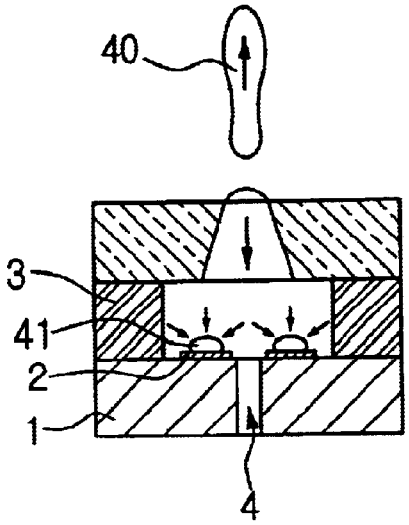

Accordingly, as shown in FIG. 5E, the bubble 41 on the top surface of the resistance heating element 2 shrinks gradually, whereby the droplet 40 at the external side of the nozzle 6 and the ink in the nozzle 6 are respectively subjected to forces in the opposite direction from each other. As a result, the droplet 40 is separated from the ink in the nozzle 6 and then ejected out.

Figure 5F:
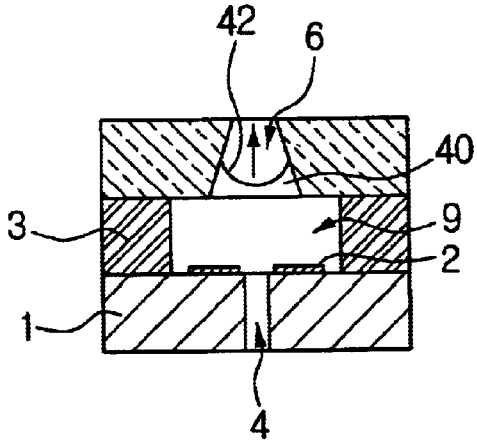

Finally, as shown in FIG. 5F, the ink flowing down the nozzle 6 into the ink chamber 9 is intercepted by the ink in the ink supplying path 4. Accordingly, a phase boundary 42 of ink moves toward an exit of the nozzle 6 due to the surface tension and the capillarity and returns to the state as shown FIG. 5A.

Other embodiments of the present invention are described referring to FIGS. 6A through 6D illustrating an ink chamber of several shapes in plan views.

Figure 6A:
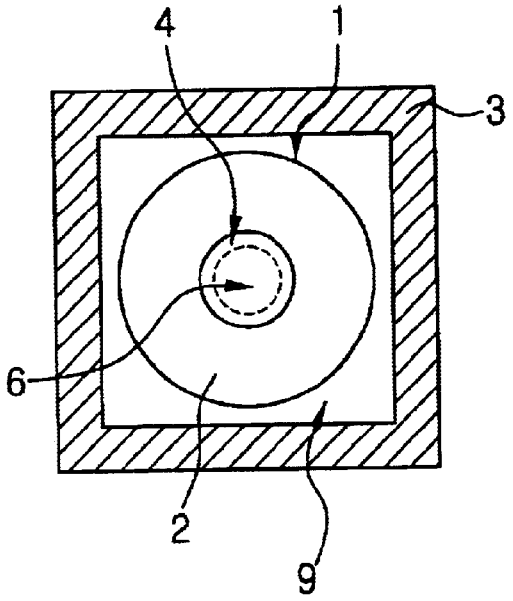
FIGS. 6A through 6D are plan views showing an ink-jet printer head according to other embodiment of the present invention.

FIG. 6A illustrates the fundamental structure of the present invention, i.e., an inside of an ink chamber barrier 3 of an ink chamber 9 having a rectangular shape and a heating resistance element 2 in a donut shape which defines an opening in a center thereof.

Figure 6B:
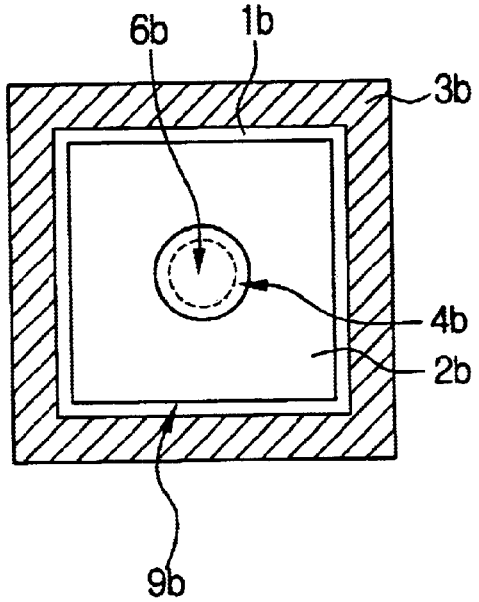
Figure 6C:
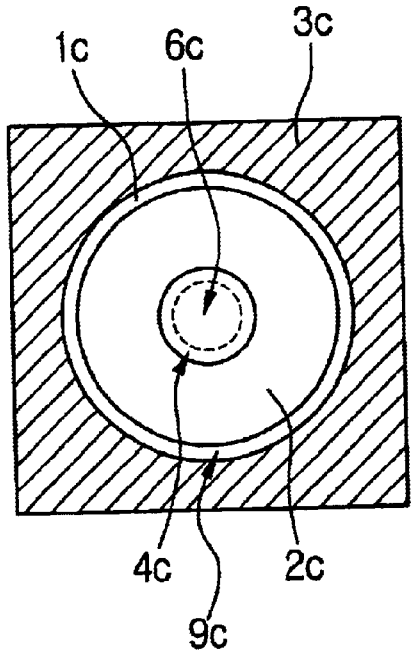

FIG. 6B illustrates the heating resistance element 2*b* having a rectangular shape, and FIG. 6C illustrates an inside of an ink chamber barrier 3*c* and the heating resistance element 2*c* having circular shapes.

Figure 6D:
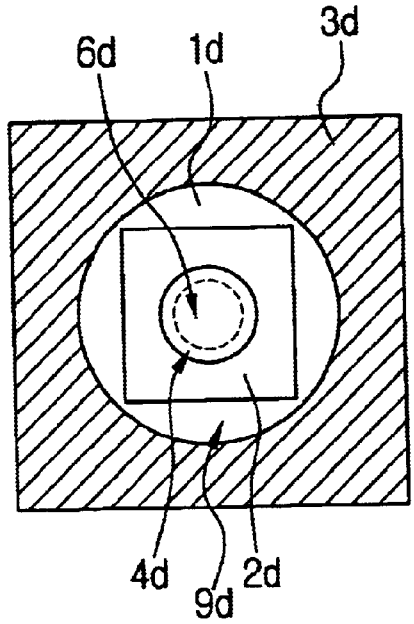

Finally, FIG. 6D illustrates an outside of an ink chamber barrier 3*d* and the heating resistance element 2*d* having rectangular shapes and an inside of the ink chamber barrier 3*d* having a circular shape.

As shown in FIGS. 6A through 6D, the heating resistance element 2, 2*b*, 2*c*, or 2*d* and the base plate 1, 1*b*, 1*c*, or 1*d* are of symmetrical configurations with respect to the center of the nozzle 6, 6*b*, 6*c*, or 6*d*, so if necessary, an inside of an ink chamber 9, 9*b*, 9*c*, or 9*d* can vary in shapes. Ink channels 4, 4*b*, 4*c*, and 4*d* are respectively shown in these figures.

According to the present invention constructed as above, the nozzle, heating resistance element 2, ink supplying path 4, ink manifold 5 are disposed about the same axis so that the expansion of a bubble and the movement of ink are made symmetrically with respect to the axis. As a result, the area of the ink ejecting apparatus can be reduced.

Accordingly, a size and a speed of an ejected ink droplet are easily controlled and a plurality of ejecting apparatuses can be arranged in the printer head for a higher print resolution. Also, enhanced printing speed can be realized.

Although a few preferred embodiments of the present invention have been shown and described, it will be appreciated by those skilled in the art that changes may be made in these embodiments without departing from the principles and spirit of the invention, scope of which is defined in the claims and their equivalents.

What is claimed is:

1. An ink-jet printer head comprising:

a single base plate having ink channels penetrating therethrough, through which ink is supplied, and the ink channels comprising, an ink manifold which is hollowed from a lower portion of the base plate to have a predetermined area, and an ink supplying path which is hollowed from the base plate to have a narrower area than that of the ink manifold, and which connects the ink manifold with the ink chamber;

a hollow heat driving section formed on the base plate and encircling an exit of the ink channels, the hollow heat driving section comprising, an oxide film, a resistance heating element stacked on the oxide film, an electrode layer etched in a predetermined pattern in order for a top surface of the resistance heating element to be exposed and stacked on the resistance heating element, and a protective layer covering the resistance heating element and the electrode layer, wherein the oxide film, the resistance heating element, the electrode layer, and the protective layer are sequentially stacked on the base plate;

an ink chamber barrier stacked on the base plate for serving as a side wall of an ink chamber where the ink is reserved; and a nozzle plate stacked on the ink chamber barrier and having a nozzle which is disposed coaxially with the ink channels and the ink chamber, the nozzle for ejecting out the ink in the ink chamber, wherein one of the ink manifold and the ink supplying path is shaped into the hollow cylinder while the other one of the ink manifold and the ink supplying path is shaped into the hollow rectangle.

2. The ink-jet printer head of claim 1, wherein the base plate, the ink channels, the ink chamber, and the heat driving section are symmetrical with respect to a shared axis, respectively.

3. The ink-jet printer head of claim 1, wherein the ink manifold is formed by sandblasting the base plate.

4. The ink-jet printer head of claim 1, wherein the ink supplying path is formed by dry etching the base plate.

5. The ink-jet printer of claim 1, wherein the heat driving section has a passage hole formed in a center thereof, connecting the ink supplying path with the ink chamber.

6. The ink-jet printer head of claim 1, wherein the resistance heating element is in a cross-sectional shape of a circle or a rectangular, with an opening formed in the center.

7. The ink-jet printer head of claim 1, wherein the ink chamber is hollowed in a shape of a cylinder or a rectangle.

8. The ink-jet printer head of claim 1, wherein the ink chamber barrier is integrally formed with the nozzle plate.

9. The ink-jet printer head of claim 1, wherein the resistance heating element is made of Ta—Al or polysilicon.

10. The ink-jet printer head of claim 6, wherein the ink chamber is hollowed in the shape of the rectangle and the heating resistance element has the shape of the circle.

11. The ink-jet printer head of claim 6, wherein the ink chamber is hollowed in the shape of the rectangle and the heating resistance element has the shape of the rectangle.

12. The ink-jet printer head of claim 6, wherein the ink chamber is hollowed in the shape of the circle and the heating resistance element has the shape of the circle.

13. The ink-jet printer head of claim 6, wherein the ink chamber is hollowed in the shape of the circle and the heating resistance element has the shape of rectangle.

14. An ink-jet printer head comprising:

a single base plate in which ink channels extend therethrough, through which ink is supplied, the ink channel having an ink manifold, which is hollowed from a lower portion of the single base plate to have a predetermined area, and an ink supplying path, which is hollowed from the single base plate to have a narrower area than that of the ink manifold;

a hollow heat driving section formed on the base plate through which the ink passes, the hollow heat driving section comprising, an oxide film, a resistance heating element stacked on the oxide film, an electrode layer etched in a predetermined pattern in order for a top surface of the resistance heating element to be exposed and stacked on the resistance heating element, and a protective layer covering the resistance heating element and the electrode layer, wherein the oxide film, the resistance heating element, the electrode layer, and the protective layer are sequentially stacked on the base plate;

an ink chamber barrier formed on the heat driving section and forming an ink chamber which receive the ink from one of the ink channels through the hollow of the heat driving section, the ink chamber connected with the ink supplying path through the ink manifold; and a nozzle plate stacked on the ink chamber barrier and having a nozzle through which the ink passes from the ink chamber in response to heating of the heat driving section;

wherein the heat driving section and the ink channels are disposed about a same axis, and one of the ink manifold and the ink supplying path is shaped into the hollow cylinder while the other one of the ink manifold and the ink supplying path is shaped into the hollow rectangle.

15. The ink-jet printer of claim 14, wherein the heat driving section heats up to form a bubble in the ink chamber to force a droplet of the ink through the nozzle, wherein movement of the ink through the ink channels and the nozzle and expansion of the bubble are made symmetrically with respect to the same axis.

* * * * *